US006532634B2

(12) United States Patent
Wilson-Brokl

(10) Patent No.: US 6,532,634 B2
(45) **Date of Patent: *Mar. 18, 2003**

(54) CREMATED REMAINS DISPLAY UPON A SUBSTRATE SYSTEM AND METHOD THEREFORE

(76) Inventor: Bettye Wilson-Brokl, P.O. Box 1016, Biloxi, MS (US) 39533

( * ) Notice: Subject to any disclaimer, the term of this patent is extended or adjusted under 35 U.S.C. 154(b) by 0 days.

This patent is subject to a terminal disclaimer.

(21) Appl. No.: 09/755,974

(22) Filed: Jan. 5, 2001

(65) Prior Publication Data

US 2001/0032380 A1 Oct. 25, 2001

Related U.S. Application Data

(63) Continuation of application No. 09/322,481, filed on May 28, 1999, now Pat. No. 6,170,136.

(51) Int. Cl.[7] ..... A61G 17/00
(52) U.S. Cl. ..... 27/1; 428/542.4
(58) Field of Search ..... 27/1, 19; 428/542.4

(56) References Cited

U.S. PATENT DOCUMENTS

| | | | | | |
|---|---|---|---|---|---|
| 1,640,680 | A | * | 8/1927 | Vanderlaan | 428/452.2 |
| D169,347 | S | | 4/1953 | Woodward | |
| 3,925,944 | A | | 12/1975 | Pickel | |
| 3,991,931 | A | | 11/1976 | McMaster | |
| 5,016,330 | A | * | 5/1991 | Botsch | 27/1 |
| 5,208,957 | A | | 5/1993 | Hereford | |
| 5,230,127 | A | | 7/1993 | Zukowski et al. | |
| 5,275,871 | A | | 1/1994 | Hambright | |
| 5,625,933 | A | | 5/1997 | Neuberger et al. | |
| 5,755,116 | A | | 5/1998 | Sparacino et al. | |
| 5,873,375 | A | | 2/1999 | Johnson et al. | |
| 5,875,528 | A | | 3/1999 | Parker | |
| 5,896,632 | A | * | 4/1999 | Sturino | 27/1 |
| 5,950,288 | A | * | 9/1999 | Bach Lahor | 27/1 |
| 5,987,720 | A | * | 11/1999 | Yamamoto | 27/35 |
| 6,200,507 | B1 | * | 3/2001 | Dennis | 264/73 |

* cited by examiner

*Primary Examiner*—William L. Miller
(74) *Attorney, Agent, or Firm*—Joseph T. Regard Ltd.

(57) ABSTRACT

A presentation system and method of preparation thereof for the display of cremated remains. Further, the system teaches a particular methodology for the artistic application of cremated remains upon a substrate for presentation. The present system contemplates a unique presentation of the cremated remains as a wall hanging in the form of a painting or the like, which includes thereupon the application of the cremated remains in an artistic and aesthetic fashion into the artwork itself. The preferred embodiment of the present system includes the steps of rendering an abstract or other artwork upon a generally flat substrate such as canvas, art board, Bristol board, or the like, then selectively applying an adhesive or like medium such as glue or the like upon the substrate and, prior to the adhesive medium's curing, applying at least a portion of the cremated remains upon the adhesive so that it adheres to the substrate, and is visible as a part of the artwork. The end result is a artwork which is pleasing to view, as well as providing a fitting remembrance to a loved one, in which the artwork can be selected to better memorialize the deceased.

6 Claims, 5 Drawing Sheets

FIG. 1
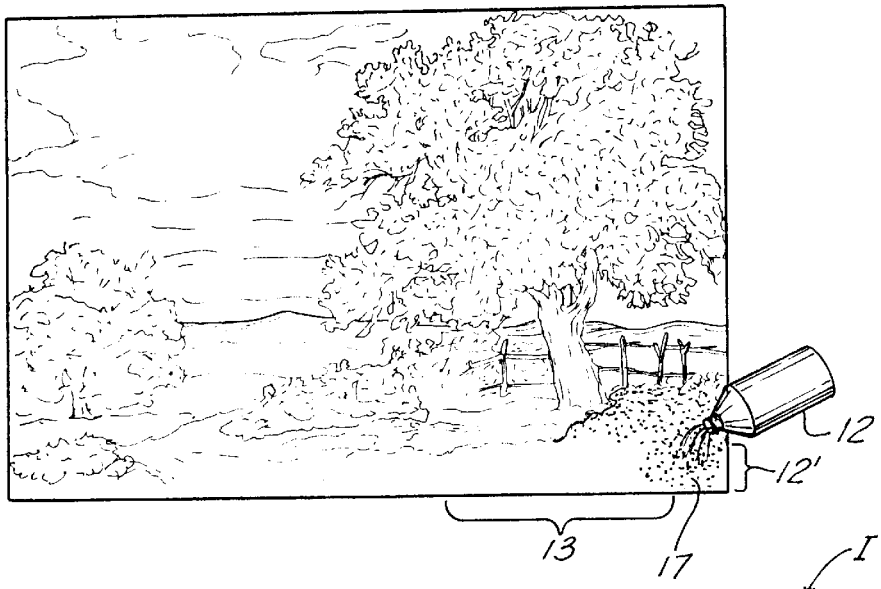
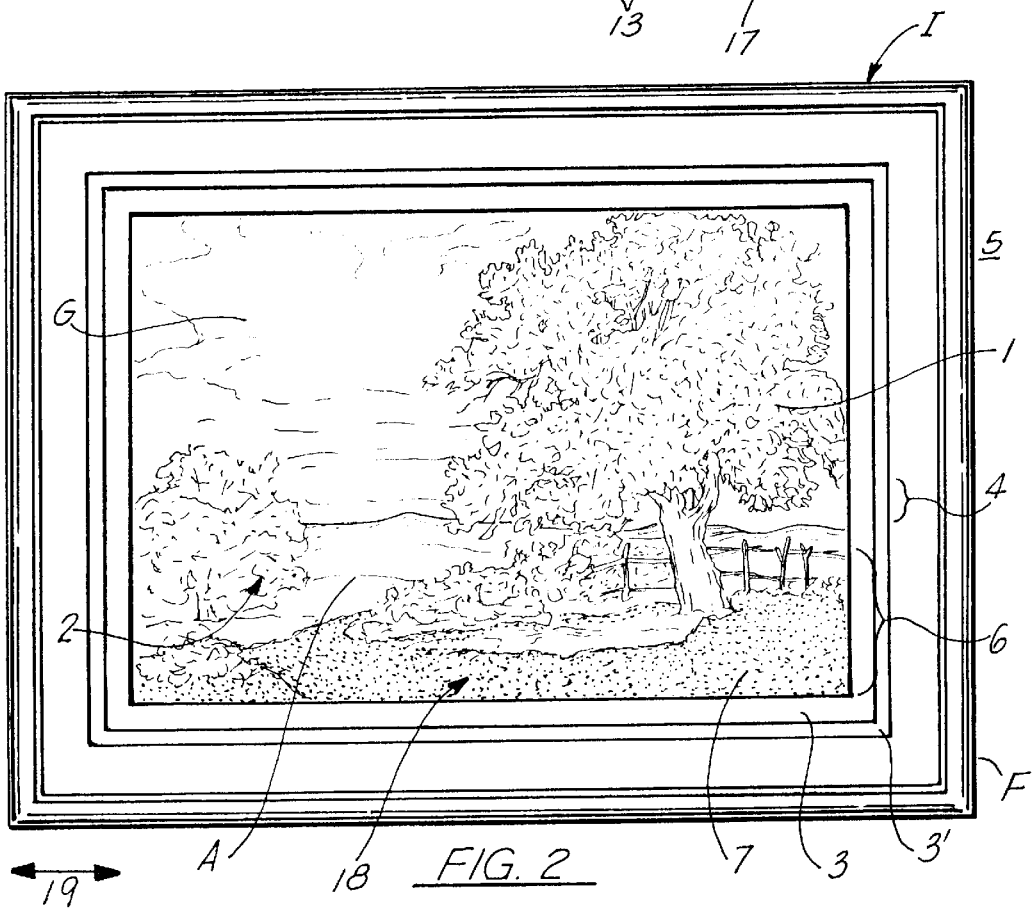
FIG. 2

CREMATED REMAINS DISPLAY UPON A SUBSTRATE SYSTEM AND METHOD THEREFORE

The present application is a Continuation of U.S. patent application Ser. No. 09/322,481 filed May 28, 1999, having issued Jan. 9, 2001 as U.S. Pat. No. 6,170,136, listing Bettye Wilson-Brokl as inventor, and entitled CREMATED REMAINS DISPLAY UPON A SUBSTRATE SYSTEM AND METHOD THEREFORE.

TECHNICAL FIELD OF THE INVENTION

The present invention relates to the memorialization of cremated remains, and in particular, to a presentation system and method of preparation thereof for the display of cremated remains. Further, the system teaches a particular methodology for the artistic application of cremated remains upon a substrate for presentation.

The present invention contemplates a unique presentation of the cremated remains as a wall hanging in the form of a painting or the like, which includes thereupon the application of the cremated remains in an artistic and aesthetic fashion into the artwork itself.

The preferred embodiment of the present invention includes the steps of rendering an abstract or other artwork upon a generally flat substrate such as canvas, art board, Bristol board, or the like, then selectively applying an adhesive or like medium such as glue or the like upon the substrate and, prior to the adhesive medium's curing, applying at least a portion of the cremated remains upon the adhesive so that it adheres to the substrate, and is visible as a part of the artwork.

An example of the present invention is show in the form of a painting of a country scene, wherein the remains are blended seamlessly into the painting to form textured items in the scene, which may include soil, tree trunks, fences, or the like, or in an abstract artwork wherein a band of cremated remains is presented upon the artwork in such a manner as to blend with and enhance same. The end result is a artwork which is pleasing to view, as well as providing a fitting remembrance to a loved one, and one in which the artwork can be selected to better memorialize the deceased.

BACKGROUND OF THE INVENTION

In the U.S., burial of the body of the deceased is still the method most widely practiced, a costly and environmentally detrimental practice. Burials can easily costs upwards of $10,000.00 plus, when one considers the casket, plot, service, memorial marker, and such. Accordingly, cremation has become more popular over the years, but among many there is a perception that there exists only limited alternatives for memorialization of cremated remains, such as keeping same in an urn, or scattering same in a ceremony.

While there exists a plethora of patents on apparatus and/or method for alternative disposal of cremated remains, including urns having viewing ports, planters, panel boxes, jewelry, building niches, and storage containers, none are believed to system of the present invention, which is believed to provide a refreshing alternative to prior art systems.

A list of patents which may have some pertinence to the present invention include:

| Patent Number | Inventor | Date of Issue |
|---|---|---|
| 1474424 | Marey | 11/20/1923 |
| 2562726 | MacDonald | 07/31/1951 |
| 3925944 | Pickel | 12/16/1975 |
| 3991931 | McMaster | 11/16/1976 |
| 5207957 | Hereford | 05/11/1993 |
| 5230127 | Zukowski et al | 07/27/1993 |
| 5275871 | Hambright | 01/04/1994 |
| 5625933 | Neuberger et al | 05/06/1997 |
| 5755116 | Sparacino | 05/26/1998 |
| 5815897 | Longstreth | 10/06/1998 |
| 5873375 | Johnson | 02/23/1999 |
| 5875528 | Parker | 03/02/1999 |
| D 169,347 | Woodward | 04/14/1953 |

As one may discern from a review of the prior art, there are many patents teaching diverse methods of keeping cremated remains, including, such traditional method as urns, as well as planters (U.S. Pat. No. 5,815,897) panel boxes (U.S. Pat. No. 5,230,127), jewelry (U.S. Pat. Nos. 5,755,116 and 5,208,957), chests (U.S. Pat. No. 3,991,931), as well as building niches U.S. Pat. No. 3,925,944.

U.S. Pat. No. 5,625,933 issued 1997 for a "Storage Container and Display for Cremated Remains", which includes not only the remains, but can include a decorative image formed thereon, "such as by silk screening, etching or embossing" displayed in conjunction with the remains. (Col 3, lines 30–35).

U.S. Pat. No. 5,875,528 teaches a "Cremation Urn" which includes a three dimensional artwork formed in LUCITE or other transparent substance, and a chamber formed in the transparent substance for later deposit of cremated remains, to provide an alternative to the traditional urn.

While none of the prior art was found teaching the method of the present invention, the practice of applying an adhesive and then applying a granular or other substance to the adhesive to enhance an artwork has been contemplated in other forms. For Example, it is known that one may apply glitter to glue while it is still wet, in order to facilitate sticking of the glue to a substrate, which may be in the form of an artistic rendering, such as is done by grade school children. For other examples of patents which contemplate the use of adhesives to bond granular substances to an substrate, see, for example, U.S. Pat. Nos. 5,873,375, or 5,275,871. Also, it would appear that there are other, non-patent references available teaching the technique of glitter applied to wet glue, as in making artistic sweatshirts and children's art.

GENERAL SUMMARY DISCUSSION OF THE INVENTION

Unlike the prior art, which has generally contemplated various depositories for cremated remains, the present invention contemplates a system for the storage and display of remains which may be personalized to the deceased in the form of an artwork and application scenario, providing a refreshing alternative to prior art systems.

It is perceived that most prior art methods of containment of cremated remains provide only limited options; indeed, generally one is left with choices simply relating to various containers, many in the form of ornate, expensive urns. The present inventor perceives that a truly different option is needed to the containers of the past, and believes that the present invention fulfills that option, providing both a means of containment of the remains, but principally providing a means of respectful and fitting display of the remains in a remembrance context which also evokes beauty and past memories of the deceased, based upon the artwork chosen in conjunction of the design, as well as the method of application and pattern of the remains upon the artwork.

As indicated, the present invention contemplates a method for the artistic application of cremated remains upon an artistically prepared substrate for presentation, in the form of a painting or like wall hanging which includes thereupon the application of the cremated remains in an artistic and aesthetic fashion blended into the work.

The preferred embodiment of the present invention includes the steps of rendering an abstract or other artwork upon a generally flat substrate such as canvas, art board, Bristol board, or the like, then selectively applying an adhesive or like medium such as glue or the like upon the substrate and, prior to the adhesive medium's curing, applying at least a portion of the cremated remains upon the adhesive so that it adheres to the substrate, and is visible as a part of the artwork. A mat or matts are then placed as borders about the artwork, for framing, but more importantly, to space the work from the glass in the frame, lending a "shadow box" effect, so as to prevent contact of the raised remains on the surface of the work with the glass.

The exemplary embodiments of the present invention are presented in two forms, an abstract artwork wherein a band of cremated remains is presented upon the artwork in such a manner as to blend with and enhance same, an in the form of a painting of a country scene, wherein the remains are blended seamlessly into the painting to form textured items in the scene, which may include soil, tree trunks, fences, or the like. As indicated, the perceived end result is a artwork which is pleasing to view, as well as providing a fitting remembrance to a loved one, and one in which the artwork can be selected to better memorialize the deceased.

It is therefore an object of the present invention to provide an alternative to the prior art remains containment and display systems.

It is another object of the present invention to provide a system for the storage and display of cremated remains which is able to be customized to provide a fitting remembrance of the deceased.

It is another object of the present invention to provide a system for the storage and display of cremated remains which provides an artwork which may be displayed in the home in a aesthetic and pleasing manner.

It is another object of the present invention to provide a system for the storage and display of cremated remains which is more cost effective than prior art systems.

Lastly, it is an object of the present invention to provide a method and system for storage and display of cremated remains which allows the user to choose a subject and artistic genre for memorialization of the deceased, wherein the cremated remains are blended in seamlessly with the artwork to form a new artwork including the cremated remains.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 1 illustrates a frontal view of an exemplary embodiment of the present invention, wherein there is provided an artwork depicting a country scene, further illustrating the application of cremated remains in the form of ashes thereupon.

FIG. 2 illustrates a frontal view of the invention of FIG. 1 in completed form.

DETAILED DISCUSSION OF THE INVENTION

Figure 3:
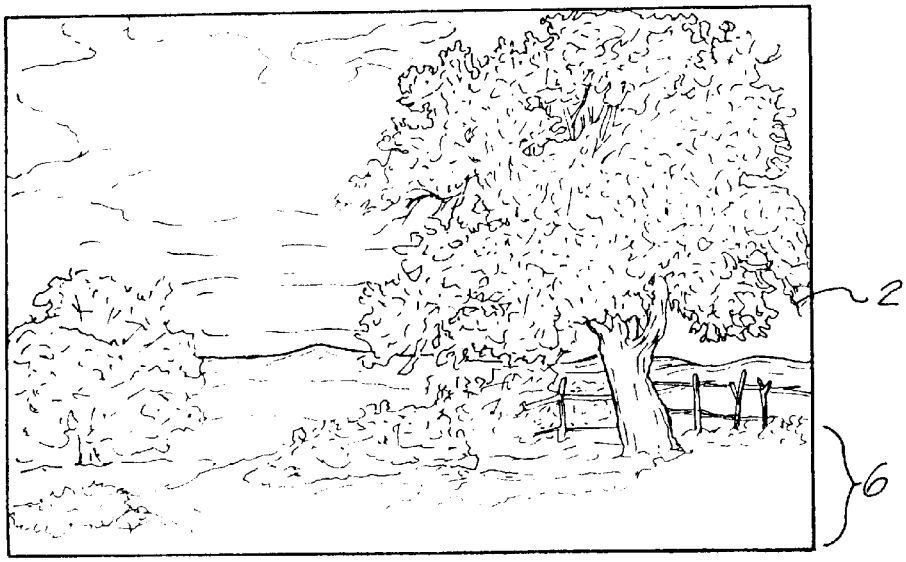
FIG. 3 illustrates a frontal view of the invention of FIG. 1 prior to application of remains thereupon.
Figure 4:
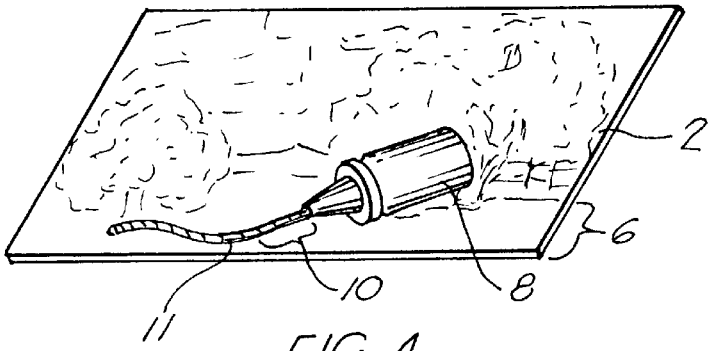
FIG. 4 is an isometric view of the invention of FIG. 1, illustrating the application of a layer of adhesive to the artwork where the ashes are to be deposited.
Figure 5:
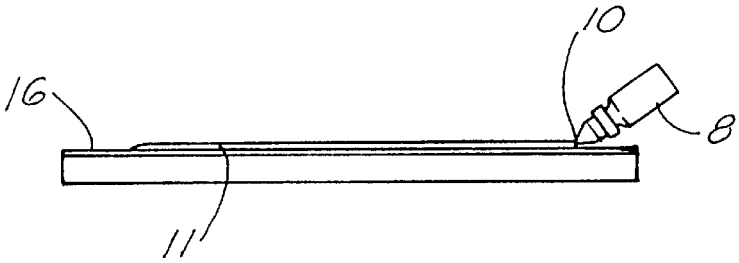
FIG. 5 is a end view of the invention of FIG. 1, illustrating the layer of adhesive upon the portion of artwork.
Figure 6:
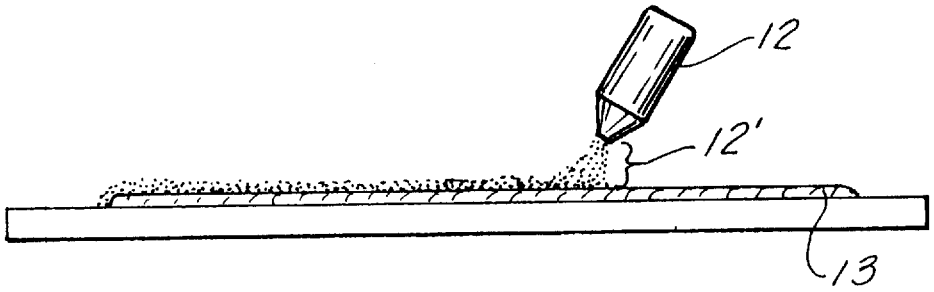
FIG. 6 is an end view of the invention of FIG. 1, illustrating the application of ashes upon the adhesive layer.
Figure 7:
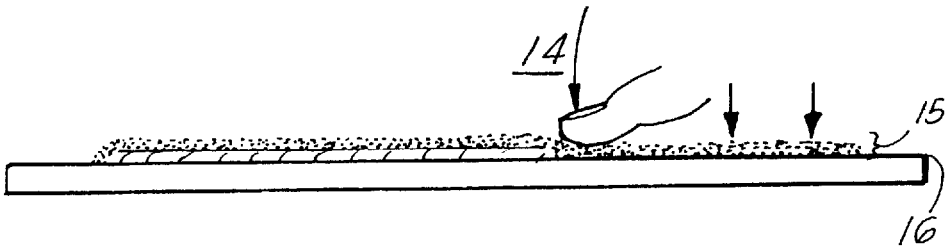
FIG. 7 is an end view of the invention of FIG. 1, illustrating the application of pressure upon the ashes applied to the adhesive layer, in such a manner as to meld said ashes into said adhesive, to provide adhesion of same.
Figure 8:
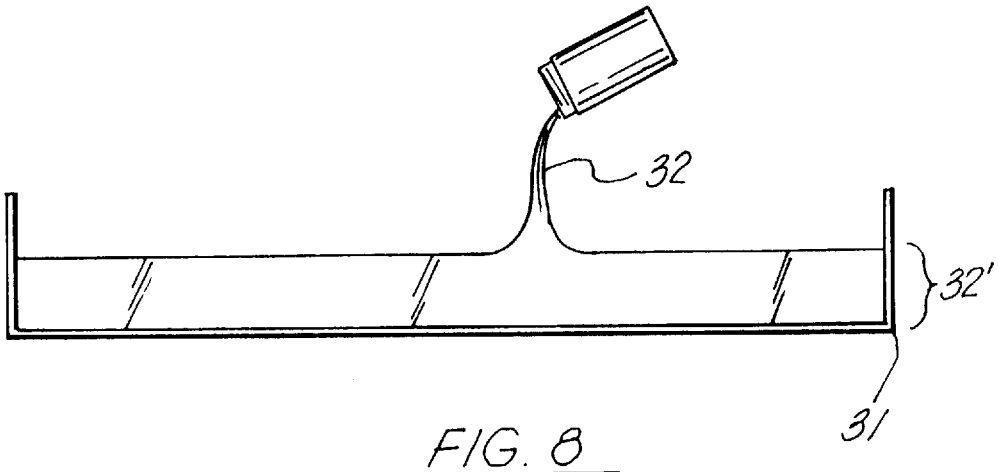
FIG. 8 is an end view of an alternative embodiment of the invention, wherein a transparent material such as LUCITE or other clear plastic or other matter is poured into a mold.
Figure 9:
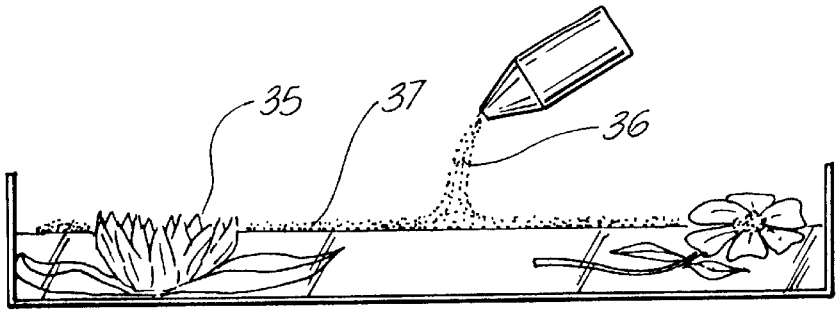
FIG. 9 is an end view of the invention of FIG. 8, wherein objects of remembrance including favorite flowers or possessions are placed upon the transparent material, and the ashes of the deceased are then applied artistically thereabout.
Figure 10:
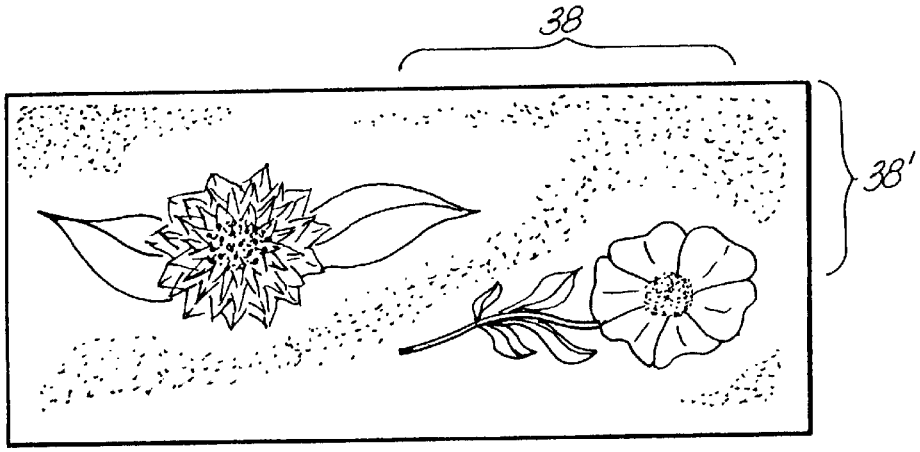
FIG. 10 is a top view of FIG. 9, illustrating an exemplary layout.
Figure 11:
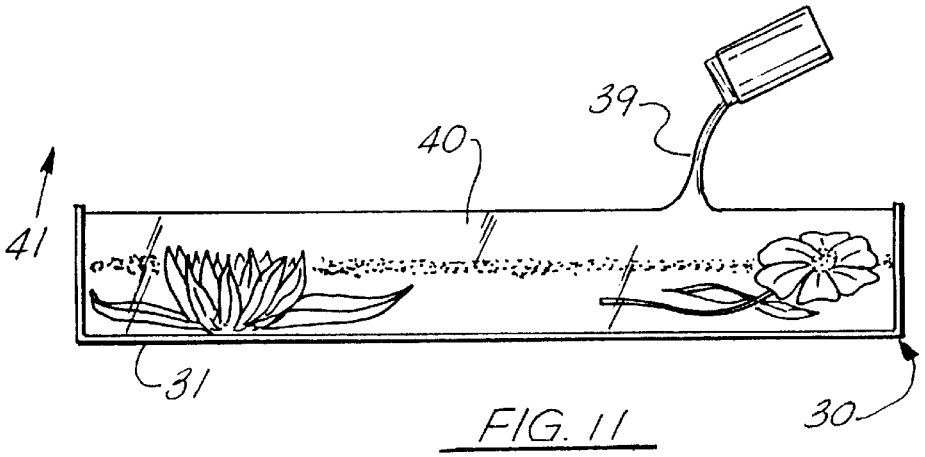
FIG. 11 is a side view of the invention of FIG. 8, illustrating the application of more transparent material into the mold, encasing the remains and applied objects.

Referring to FIG. 2, the present invention I comprises an artwork A encompassed by a frame F and glass G, which artwork may be in the form of a painting 1 of preferably something associated with the deceased, in this case a scene 2 landscape which might be representative of the home of the deceased, which scene is separated or spaced 4 from the glass, and framed via mats 3, 3', the present embodiment intended to be hung vertically on, for example, a wall 5.

Continuing with FIGS. 1–7, to make the present invention, an painted scene 2 or other artistic work is prepared, which artistic work may include an area 6 designated for application of the remains thereto, in such a manner that the remains blend in with the artwork. In the present instance, the area represents the earth, wherein the application of the cremated remains, comprising ashes thereto would add texture and color which could be interpreted as simulating the appearance of the earth, thereby providing a painting wherein the remains become a part of the artistic work in a manner which enhances the work, while providing a respectful presentation and remembrance of the deceased. In the exemplary artwork, other areas which could be enhanced by the textured appearance and color of the remains might include, for example, the trunk of the tree, or the clouds represented in the scene.

Once the area for application of the remains is designated, and the painting completed, an adhesive 8 is applied 10 to the substrate 16 in the designated area 6, leaving adhesive 11 upon the substrate, which may be in the form of a bead or several beads, which bead or beads may be spread about on the surface upon the designated area. The adhesive may also be applied via a brush or spray to cover the designated surface.

After application of the adhesive within the bounds of the designated area 6, cremated remains 12, in this case, in the form of ashes 12 are sprinkled 12' upon the still wet adhesive 13, and pressure 14 is applied to the top of the sprinkled ashes toward the substrate 16 in order to meld the ashes into the adhesive to form an adhesive/ash matrix 15, wherein a portion of the ashes 17 still remains external the adhesive, preferably. The adhesive is then allowed to dry 18, firmly adhering the ashes to the substrate. The substrate may then be shaken 19 in order to loosen and remove any ashes which may not be firmly adhered to the substrate. An example of suitable adhesive may include, for example, ELMER'S brand glue, or 3M brand contact adhesive. Also, various paints, including acrylic paint, oil paint or the like, when applied to a sufficient amount to the substrate, may also adhere to the ashes when same is applied thereon. Therefore, in some instances, the ashes may be applied to portions of the artwork while the paint is still wet, within the designated areas, and pressure applied to the applied ashes to meld same into the still wet paint, and the paint allowed to dry, which technique may also provide satisfactory results.

Figure 12:
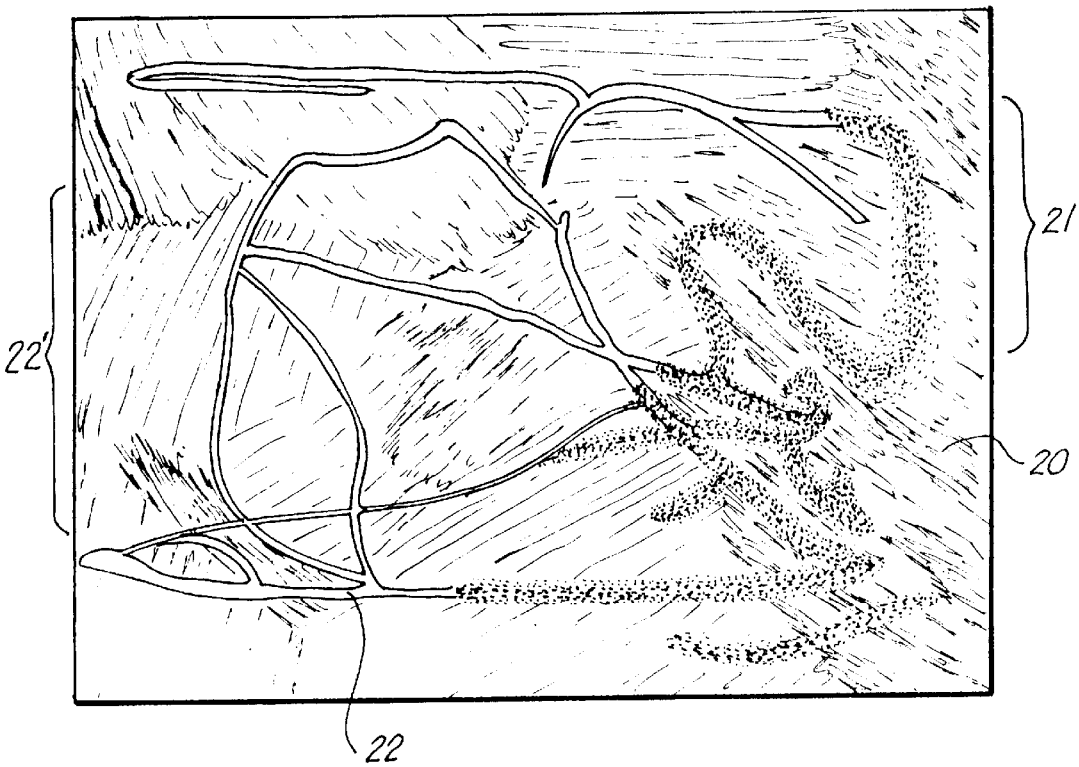
FIG. 12 is a frontal view of a preferred embodiment of the present invention, illustrating an abstract artwork having a bead of adhesive artistically applied thereto, with the cremated remains partially applied thereupon.
Figure 13:
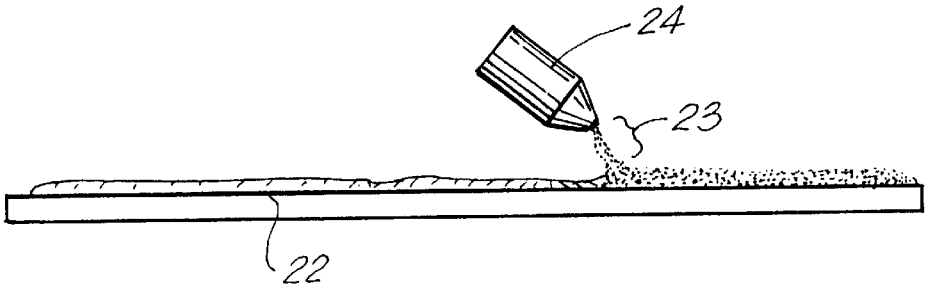
FIG. 13 is an end view of the invention of FIG. 12, illustrating the bead of adhesive, with the application of the cremated remains thereupon.
Figure 14:
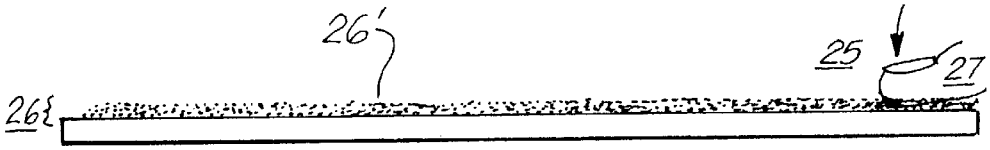
FIG. 14 is an end view of the invention of FIG. 12, illustrating the application of pressure upon the cremated remains, so as to blend in or meld same with the adhesive.

FIGS. 12–14 contemplate another version of the present invention, wherein there is illustrated an abstract artwork 20 having no easily perceived bounds 21 as one might perceive in the earlier discussed embodiment, and wherein there is applied thereupon a bead 22 or beads of adhesive about 22' the artwork in an artistic fashion, thereafter sprinkling 23 remains 24 upon the still wet adhesive bead 22 and, while the adhesive is still wet, applying 25 pressure upon the remains or ashes to meld same with the adhesive, facilitating an ashes/adhesive matrix 26 with a layer of ashes forming the top layer 26' thereupon.

Pressure may be applied by, for example, a finger 27, or any flat or other surface as desired. As with the earlier discussed embodiment of the invention, preferably, once the adhesive is allowed to dry, the completed work is shaken to dislodge remains likely to come off in the future, then the unit is framed with a glass cover, an spaced via a mat or mats so that the remains, which may be raised from the surface do not engage, and are separated from, the glass.

FIGS. 6–11 illustrate an alternative method of encapsulating, preserving, and displaying remains and mementos of a loved one, wherein a mold or container 31 is partially filled with a liquid plastic substance. Next, mementos, which may comprise, for example, favorite flowers, photos, or personal items may be carefully arranged upon or within the poured liquid plastic material in spaced fashion.

Cremated remains 36 are then carefully applied to the surface 37 in artistic fashion 38, carefully applying same as a layer along the same plane, or partially within the applied plastic substance in three dimensions, to form an artwork comprising the arrangement 38' of the cremated remains and the mementos.

Lastly, clear liquid plastic material, for example, LUCITE or the like is poured to encase 39 the arrangement. The liquid plastic material applied into the mold or container is then allowed to harden 41 and the contents removed 41 from the mold or container.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. The method of displaying cremated remains of a deceased on a substrate having an outer surface comprising the steps of:

a. applying wet paint to the outer surface of said substrate so as to form a graphic or pictorial artwork;

b. applying said cremated remains upon said wet paint so as form a portion of said artwork;

c. allowing said wet paint to cure, permanently adhering said cremated remains to said substrate, providing a cured said artwork.

2. The method of claim 1, wherein there is further provided after step "c." the additional step "d." of shaking said cured artwork in order to dislodge said cremated remains inadequately adhered to said substrate.

3. The method of claim 2, wherein said cured artwork has a periphery, and wherein there is further provided after step "d." the additional step "e." of placing a framing mat about said periphery of said cured artwork, and framing said cured artwork and said mat with a frame having glass.

4. The method of displacing cremated remains of a deceased upon a substrate having a surface comprising the steps of:

a. applying an uncured graphic or pictorial artwork to the surface of said substrate;

b. applying said cremated remains to said uncured graphic or pictorial artwork so as to form a portion of said graphic or pictorial artwork.

c. allowing said uncured graphic or pictorial artwork to cure, permanently adhering said cremated remains upon said graphic or pictorial artwork, providing a cured said artwork.

5. The method of claim 4, wherein there is further provided after step "c." the additional step "d." of shaking said cured artwork in order to dislodge said cremated remains inadequately adhered to said substrate.

6. The method of claim 5, wherein said cured artwork has a periphery, and wherein there is further provided after step "d." the additional step "e." of placing a framing mat about said periphery of said cured artwork, and framing said cured artwork and said mat with a frame having glass.

* * * * *